United States Patent [19]

Del Nero

[11] 4,316,371

[45] Feb. 23, 1982

[54] HIGH SAFETY BOLT CONTROL DEVICES

[75] Inventor: Claude Del Nero, Le Chesnay, France

[73] Assignee: Fichet-Bauche, France

[21] Appl. No.: 113,182

[22] Filed: Jan. 18, 1980

[51] Int. Cl.[3] ..... E05B 63/00

[52] U.S. Cl. ..... 70/417; 70/451; 70/452

[58] Field of Search ..... 70/417, 452, 451, 416, 70/381, 447; 292/346

[56] References Cited

U.S. PATENT DOCUMENTS

| | | | |
|---|---|---|---|
| 3,083,563 | 4/1963 | Greenwald | 70/417 |
| 4,073,172 | 2/1978 | Schlage | 70/417 |
| 4,074,552 | 2/1978 | Smith | 70/417 |
| 4,160,368 | 7/1979 | Solow | 70/417 |
| 4,237,712 | 12/1980 | Cramer | 70/417 |

*Primary Examiner*—Robert L. Wolfe

*Attorney, Agent, or Firm*—Kane, Dalsimer, Kane, Sullivan and Kurucz

[57] ABSTRACT

A bolt assembly used for locking and unlocking a door-leaf, which comprises a bolt movable from the outside by a key introduced into the barrel of a safety cylinder, the housing of the barrel comprising a flange which can be immobilized in rotation and translation by three plates fixed to the outer surface of the door by bolt means, a fourth plate covering said bolt means. This plate is treated against drilling, and the last three plates are soldered to each other and lodged in a housing.

By loosening the bolt means and removing the first plate, the safety cylinder can be replaced.

27 Claims, 10 Drawing Figures

HIGH SAFETY BOLT CONTROL DEVICES

BACKGROUND OF THE INVENTION

The present invention relates to bolt assemblies used for locking and unlocking door-leaves or similar articles, and which comprise a bolt slidably housed inside a casing fixed on the inner face of the door-leaf, and movable from the outside by a key which is introduced into the barrel of a safety cylinder, the rotation of the barrel, after insertion of the key, being possible only if the latter is the key corresponding to the barrel, the movement being transmitted to the bolt through a tail-piece carried by the barrel.

In a known bolt assembly of this type, the safety cylinder, housed inside a passage extending through the door-leaf and whose end which is turned towards the outside, or outer end, projects relative to the door-leaf, is rigidly connected to the latter by two screws engaged in a plate placed between the inner or internal face of the door-leaf and the casing.

While benefiting from the security due to the safety cylinder, the fraudulent opening of a door provided with such a bolt assembly is not excluded when rotating directly the end of the cylinder which is protruding relative to the outer face of the door-leaf.

BRIEF DESCRIPTION OF THE INVENTION

The object of the invention is therefore to provide a bolt assembly with which in particular such a fraudulent action is made impossible and which opposes efficiently any drilling, boring, tearing off or other such action.

A further object of the invention is to obtain this result by means which are simple to use and of little cost.

A further object of the invention is to increase the safety provided by a standard type bolt assembly by providing means such that the safety cylinder may be easily replaced.

A further object of the invention is to provide a device allowing transforming existing barrel safety cylinder bolts into high safety bolt assemblies according to the invention.

According to the invention, said advantages are obtained by immobilizing in rotation the outer portion of the safety cylinder casing in a plate rigidly connected to the door-leaf by fixation means, on the outer face of said leaf, a second plate covering the first so that the fixation means are not accessible from the outside and the front faces of the safety cylinder and barrel casing are disposed in a sunk position relative to the front surface of said second plate.

Advantageously, the plates are subjected to a surface treatment, particularly carbo-nitridation.

The invention foresees that the two plates are rigidly connected to each other by soldering.

A hood housing the two plates may thereafter by crimped on the inner face of the first plate.

The fact that the safety cylinder casing is fixed in rotation in the first plate is obtained in a simple way by providing that a flange which is rigid with the casing is engaged in an opening of mating shape formed in the first plate.

The fixation means are provided for example in the form of four headed screws or screw bolts housed in recesses of corresponding shape of the first plate.

The second plate covers completely the heads of the screws and partly the front face of the safety cylinder, the key opening being the only element to be accessible through a corresponding cutting of the second plate and the hood.

In a preferred embodiment, one uses, instead of a first plate, two adjacent plates, the rear plate being used for immobilizing in rotation the safety cylinder body flange and supporting the fixation screw heads, and the adjacent front plate being used for immobilizing in rotation the fixation screw heads and covering the flange.

In this embodiment, the two adjacent rear and front plates are also rigidly connected to each other by soldering.

Advantageously, an extra plate is also foreseen which is placed between the first plate or the two adjacent plates and the outer face of the door-leaf, the function of which is to provide a support for the safety cylinder flange for preventing said cylinder from being driven out.

In order to easily disassemble the device according to the invention, and in particular to change the safety cylinder, the extra plate is not soldered to the first plate or to the rear adjacent plate, not fixed in position by the crimping of the hood.

BRIEF DESCRIPTION OF THE DRAWINGS

The invention will become more apparent from the following description which is given by way of example, reference being made to the accompanying drawings wherein.

DETAILED DESCRIPTION OF THE INVENTION

Figure 1:
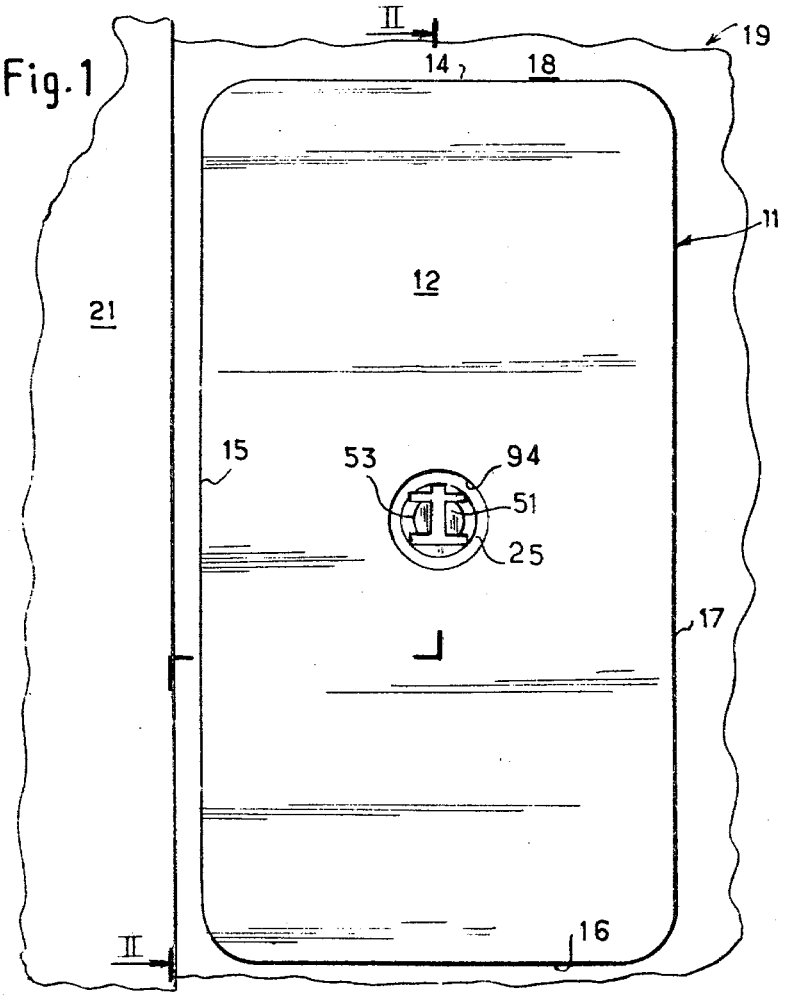
FIG. 1 is a view of the outer face of a door-leaf provided with the bolt arrangement according to the invention.

The high safety bolt assembly 11 of the invention comprises (FIG. 1) an outer hood 12 in the shape of a flat parallelepipedal cup with its outer or front bottom 13 (FIG. 2) joined to side walls 14, 15, 16, 17, with their edges which are opposite bottom 13 bearing on or somewhat spaced from the outer face 18 of door-leaf 19 or similar article which has to be fixed in position relative to a door frame 21 by a bolt 88–89.

Between face 18 of the door-leaf 19 and the inner face of bottom 13 are successively housed four plates, respectively 22, 23, 24 and 25, of general rectangular shape and corresponding to the shape of the bottom 13 of the hood 12, the plates 23 to 25 being housed inside the volume bounded by the hood 12.

Figure 2:
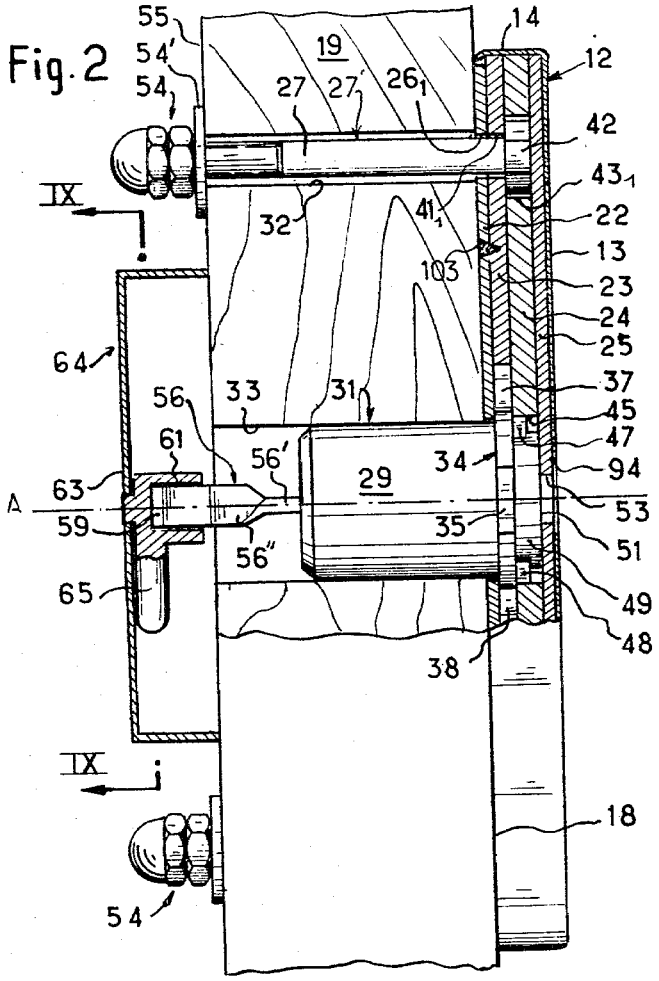
FIG. 2 is a view of a door-leaf, as seen along its edge, in elevation and partly in cross-section, and provided with a bolt arrangement according to the invention.
Figure 3:
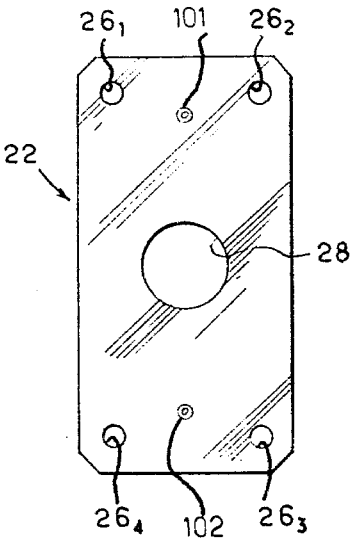
FIG. 3 is a frontal view of the inside face of a plate.

In plate 22 (FIG. 3) are formed on the one hand through holes 101, 102, for example of conical shape tapering towards plate 23 and provided for receiving screw heads 103, only one of which is shown on FIG. 2, which maintain the plate 22 on the plate 23, and on the other hand, adjacent the four chamfered angles of plate 22, through holes $26_1$, $26_2$, $26_3$ and $26_4$ through which extend the stems 27 of screw bolts 27' (the screw bolt corresponding to hole $26_1$ being the only one to be shown in FIG. 2) and a central circular hole 28, centered on the axis of symmetry A of plates 22 to 24, provided for the passage of the cylindrical body 29 of a safety cylinder 31. The screw bolt stems 27 and the cylindrical body 29 of the safety cylinder 31 are housed inside through-going holes 32, 33 of the door-leaf 19.

Figure 4:
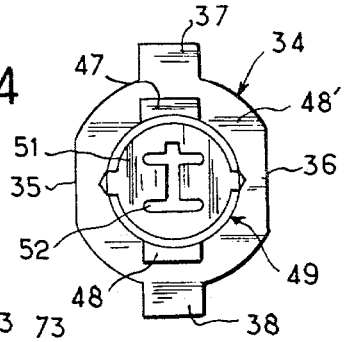
FIG. 4 is a frontal view of a safety cylinder, as seen from its end turned towards the outside.
Figure 8:
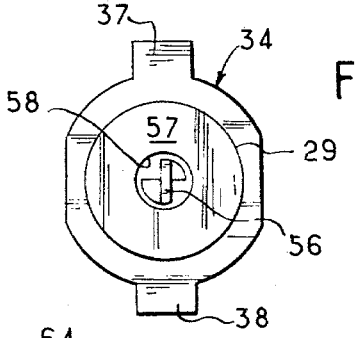
FIG. 8 is a frontal view of the safety cylinder as seen from its end turned towards the inside.

To the front or outer portion of body 29 is rigidly connected a flange 34 which is protruding transversely relative to body 29 and the periphery of which is therefore more remote than said body from the axis A of cylinder 31. The flange 34 has the general shape of a circular ring, with the exception of two parallel diametrically opposite flat portions 35, 36 (FIG. 4) and of two rectangular lugs 37, 38, in alignment along a diameter which is perpendicular to the average diameter of the flat portions 35, 36.

Figure 5:
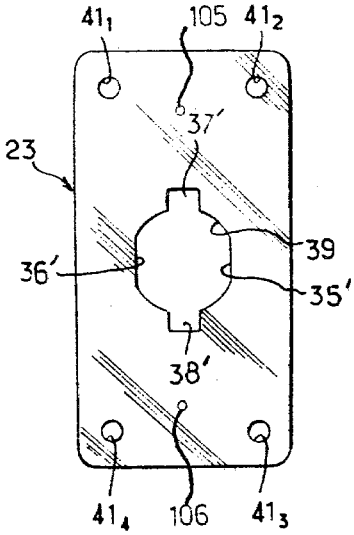
FIG. 5 is a frontal view of the inside face of a plate.

The flange 34 is tightly lodged between plates 22 and 24 inside a central opening 39 (FIG. 5), of corresponding shape with flat portions 35', 36' and rectangular notches 37', 38' formed in the plate 23 which comprises, adjacent its angles, and in alignment with holes 26 of plate 22, through-going holes of same diameter $41_1$, $41_2$, $41_3$ and $41_4$.

The threaded ends of screws 103 are fixed into tapped threaded holes 105, 106 of plate 23, positioned in register with holes 101, 102 of plate 22.

Figure 6:
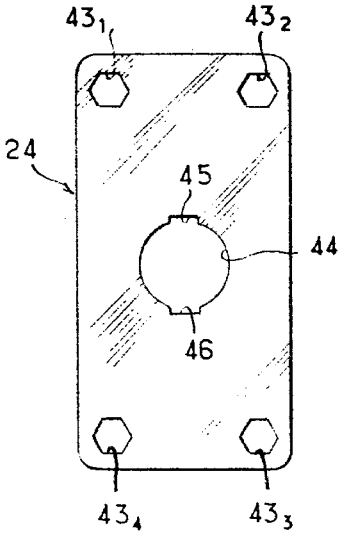
FIG. 6 is a frontal view of another plate.

The stems 27, which are engaged in the holes 26 and 41 of plates 22 and 23, end outwardly into hexagonal heads 42 bearing by their inner face on the outer face of plate 23 and tightly housed in hexagonal holes $43_1$, $43_2$, $43_3$ and $43_4$ (FIG. 6) extending through plate 24 which has a central opening of general circular shape 44, with two cuts 45, 46, diametrically opposite, in which are tightly housed the transversally outer portions of blocks 47, 48 of general parallelepipedal shape, rigidly connected and protruding relative to the outer face 48' of flange 34.

Figure 7:
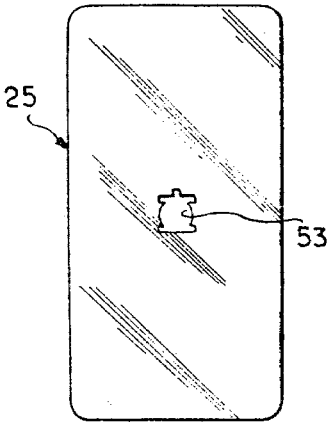
FIG. 7 is a frontal view of the inside face of still another plate.

In opening 44 is engaged the front or outer portion of a barrel 49 rotatably housed and controlled by the key in the cylindrical body 29 of the safety cylinder 31, the outer edge 51 of the barrel 49, which is slightly protruding relative to blocks 47 and 48 and formed with an opening 52 for the key, being applied against the inner face of plate 25 in which is formed an opening 53 (FIG. 7) for the passage of the key operating the barrel 49.

The construction of the safety cylinder, of its body, of the barrel and of the means for immobilizing or releasing the barrel relative to the body are well known and described for instance in British Pat. No. 678,123.

Advantageously, the plate 25 is made from a carbon treated metallic alloy, so as to make it difficult to drill.

The plates 23, 24 and 24, 25 are soldered to each other and the sandwich assembly thus formed is covered by the hood 12 which is fixed around plates 23, 24 and 25 by crimping around the inner edge of plate 23 the side walls 14, 15, 16 and 17 of the hood.

The plate 22 has a surface of slightly smaller area than that of plates 23 to 25, so that it can bear on plate 23 in spite of the slight rolling-in due to the crimping of hood 12, the plate 22 being fixed on plate 23 by the screws 103.

On the threaded inner ends of screw bolts stems 27 are screwed nuts 54 which provide the fixation of hood 12 on the door-leaf 19 by pressing washes 54' against the inner face 55 of the door-leaf.

To the barrel 49 is rigidly connected a transmission member or tail piece 56 in the shape of a bar comprising two flat portions which are transverse to each other, so as to form a T, the first flat portion being lodged into body 29 and engaged into a slot at the inner end of barrel 49 and being connected, by a helical portion 56' extending through a hole 58 of the bottom 57 of body 29 of the safety cylinder 31, to the second flat portion 56'' the rear or inner end 59 of which is engaged in a slot 61 of a circular boss 62 (FIG. 9) to which is rigidly connected a finger 65 and which is rotatably mounted on the bottom 63 of an inner casing 64 fixed on the inner face 55 of the door-leaf 19.

The free end 66 of the finger 65 is adapted for being engaged into a notch 67 provided in a boss 68 formed on a face 69 of a general parallelepipedal shaped body 71 sliding, under the action of finger 65, on a rail 72 placed on the bottom 63 of casing 64.

The portion of said casing which is opposite that which houses the boss 62 has the shape of a courb provided with three superposed fingers 73, 74, 75, providing between themselves notches 76, 77 in which are housed, when the door-leaf 19 is in its closed condition, lugs 78, 79 formed with through-going holes 81, 82 and rigid with a plate 83 fixed on the door frame 21.

Latch bolts 88, 89 are adapted for engaging into holes 81, 82 through openings 84–87 (FIG. 10) formed in the faces in register of casing 64 which bound the notches 76, 77, said latch bolts being parallel to the rail 72 and carried at the ends of arms 91, 92 rigid with the face 93 of body 71 which is opposite face 69.

For mounting the bolt assembly, the hole 33 is first drilled in the door-leaf 19 for housing the safety cylinder 31 as well as the four holes 32 for the passage of the screw bolts stems 27.

Plate 23 is then soldered to plate 24, and the stems 17 of the screw bolts 27' are inserted in the holes 43 and 41 so that the heads 42 of the screw bolts 27' are engaged into the holes 43. The plate 25 is thereafter placed on the plate 24 and soldered to it, thereby fixing the heads 42 inside the volume bounded by the holes 43, the plate 23 and the plate 25. The sandwich assembly formed by the plates 23 to 25 is then introduced inside the hool 12, the side walls 14, 15, 16 and 17 of which are crimped about the periphery of plate 23, thereby locking said plates inside the hood, as hereabove indicated, as well as the heads of the screw bolts 27. The front portion of barrel 49 is introduced in the opening 44 of plate 24 and the flange 34 of body 29 of cylinder 31 is engaged in the opening 39 of plate 23, said cylinder having been previously provided with the tail part 56. The plate 22 is threaded onto the body 29 of cylinder 31 via its opening 28 and onto the stems 7 of the screw bolts 27' via its openings 26 so that the outer face of plate 22 comes to bear against the inner face of flange 34 and plate 23, the plate 22 being thereafter fixed on plate 23 by the two screws 103 thereby connecting rigidly the cylinder 31 to the plates 22 to 25 and the screw bolts 27'. The assembly thus formed is fixed to the door-leaf 19 by introducing the screw bolts 27 inside the holes 32 and the cylindrical body 29 inside the hole 33, and the screw bolts 54 are screwed after the washers 57' have been placed on the inner protruding ends of the screw bolts.

The casing 64 is then rigidly connected by means not shown but well known to the inner face 55 of the door-leaf 19, the flat inner end of the operating member or tail part 56 being engaged inside slot 61, and the plate 83 is fixed to the door frame 21.

For opening the door from the outside when it is locked, the bolt assembly is operated in the usual manner by the owner of the right key who introduces it via a hole 94 formed in the front bottom 13 of hood 12 into the key opening 52, the rotation of the barrel providing the retraction of the latch bolts 88, 89 through the tail piece 56, the finger 65, and the body 71, the latch bolts 88 and 89 being then entirely housed inside the teeth 74, 75 of casing 64.

Figure 9:
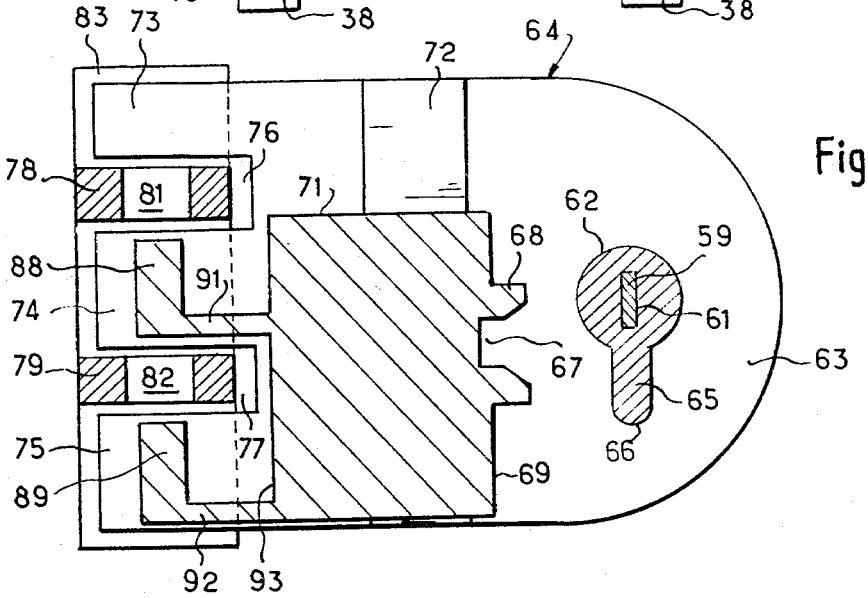
FIG. 9 is a sectional view along line IX—IX of FIG. 2 in a first condition of the bolt.
Figure 10:
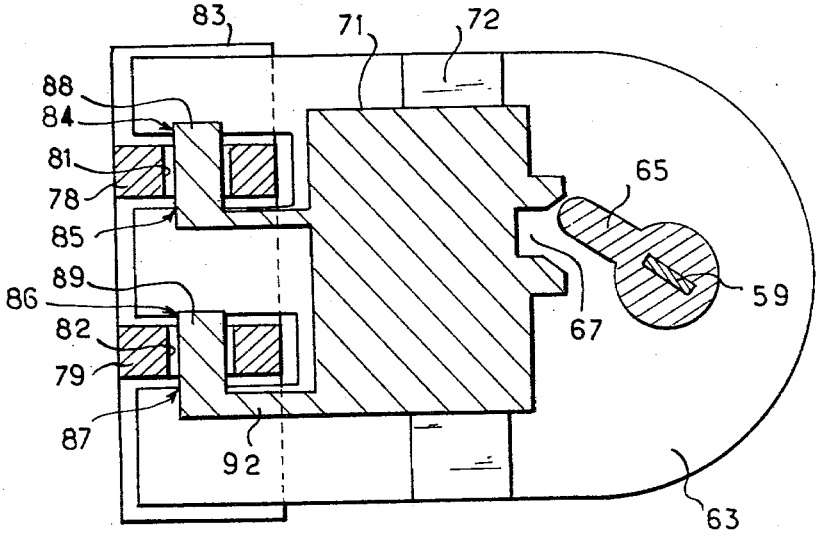
FIG. 10 is a view similar to FIG. 9, for a second condition of the bolt.

The locking operation is carried out in the reverse manner, the latch bolt passing then from its condition shown in FIG. 9 to the condition shown in FIG. 10 in which the latch bolt 88 extends through opening 85 into hole 81 of the lug 78 and from there to the opening 84, the latch bolt 89 extending through opening 87 into the hole 82 of lug 79 and from there to opening 86. Means which are known per se oppose the displacement of body 71 when said body is not drawn along by finger 65.

There is no portion of cylinder 31 or of barrel 49 which is protruding over the outer face of the hood 12 so that it is impossible, even when using lipped tongs, to cause directly the rotation of the cylinder or of the barrel.

The plate 25 made of a particularly resistant treated metal resists drilling attempts.

The cooperation of the inner face of the flange 34 with the outer face of plate 22 prevents the cylinder 31 from being driven in when there is a house-breaking attempt.

However, in case of need, the safety cylinder 31 may be easily changed. One needs only to release the hood assembly after having unscrewed the nuts 54 from the inside, to remove the plate 22 after having unscrewed the screws 103 by sliding it along the stems 27 of the screw bolts 27', the crimping being not carried out on said plate, thereby allowing disengaging the cylinder 31 and replacing it by a new one. The subsequent assembly of the new cylinder is carried out in the same way as previously described.

In a typical embodiment, the door-leaf has a thickness of about $1\frac{3}{4}''$, the diameter of the hole 33 is about $1\frac{1}{4}''$, the diameter of holes 32 is about $\frac{3}{8}''$, the total thickness of plates 22 to 25 if about $\frac{1}{2}''$, and the size of the rectangular plates is about $3\times6''$.

The drawing and the text of this application offer a detailed description of a preferred embodiment of the present invention, it being well understood that the invention is not limited to this specific embodiment, but covers all modifications or alternatives which are within the scope of the invention such as is defined in the claims.

Particularly, the invention can be applied to bolts wherein the latch bolt can also be operated through an inner knob independently from the key operating the latch bolt from the outside.

Similarly, the invention may be applied with other connecting means than soldering for establishing the rigid connection of the plates to each other.

I claim:

1. In a high safety bolt mounted on a door-leaf having an inner face and an outer face, for the locking and unlocking of said door-leaf and comprising:

a latch bolt movably housed in translation in a casing fixed on the inner face of the door-leaf and having a locking and an unlocking position;

a safety cylinder housed in a hole extending through the door-leaf and comprising a cylindrical body in which is housed, rotatable by a key, a barrel with an outer face having a key opening accessible from the outer face of the door-leaf;

a transmission member for the movement of the barrel to the latch bolt for displacing the latter to its locking or unlocking position when the barrel is rotated, the improvement comprising:

a first plate on the side of the outer face of the door-leaf, fixed to the latter by fixation means, immobilizing said cylindrical body in rotation and comprising an outer face, a second plate fixed to the outer face of the first plate for preventing the access to the immobilization means of the cylindrical body, said second plate extending over the outer face of the barrel, and formed with a hole placed in register with the key opening, and means for covering the fixation means.

2. In a high safety bolt mounted on a door-leaf having an inner face and an outer face, for the locking and unlocking of said door-leaf and comprising:

a latch bolt movably housed in translation in a casing fixed on the inner face of the door-leaf;

a safety cylinder housed in a hole extending through the door-leaf and comprising a cylindrical body in which is housed, rotatable by a key, a barrel with an outer face having a key opening accessible from the outer face of the door-leaf;

a transmission member for the movement of the barrel to the latch bolt for displacing the latter in a translation movement when the barrel is rotated, the improvement comprising:

a first plate on the side of the outer face of the door-leaf, fixed to the latter by fixation means and immobilizing said cylindrical body in rotation and comprising an outer face;

a second plate fixed to the outer face of the first plate for preventing the access to the immobilization means of the cylindrical body, said second plate extending over the outer face of the barrel, and formed with a hole placed in register with the key opening;

means for covering the fixation means; and a hood provided with a key opening, in the general shape of a cup and housing the second plate and the first plate, and crimped onto the latter.

3. In a high safety bolt mounted on a door-leaf having an inner face and an outer face, for the locking and unlocking of said door-leaf and comprising:

a latch bolt movably housed in translation in a casing fixed on the inner face of the door-leaf and having a locking and an unlocking position;

a safety cylinder housed in a hole extending through the door-leaf and comprising a cylindrical body in which is housed, rotatable by a key, a barrel with an outer face having a key opening accessible from the outer face of the door-leaf;

a transmission member for the movement of the barrel to the latch bolt for displacing the latter to its locking or unlocking position when the barrel is rotated, the improvement comprising:

a first plate for immobilizing in rotation the cylindrical body, placed on the side of the outer face of the door-leaf and fixed to it by fixation means engaged into passage holes formed in the plate, said means comprising a front end wider than said passage holes;

a second plate formed with holes for housing said ends of the fixation means, with a hole for housing the barrel front end, and fixed on the outer face of the first plate; and a third plate fixed on the second plate for covering said ends of the fixation means and comprising a through-going hole placed in register with the key opening, the third plate extending over the outer face of the barrel.

4. A bolt according to claim 3, wherein the first and second plates, as well as the said second plate and the third plate, are fixed to each other by soldering, a cup-shaped hood with an opening for the key housing the three plates and being crimped around the first of said plates.

5. A bolt according to claim 4, wherein the immobilization in rotation of the body of the safety cylinder relative to the first plate is provided by housing a non circular shaped flange which is rigid with the safety cylindrical body in a hole of mated shape.

6. A bolt according to claim 5, wherein a fourth plate is foreseen between the outer face of the door-leaf and the first plate, comprising a hole for the passage of the cylindrical body the diameter of which is such that the flange bears against the fourth plate, in addition of bearing against the second plate.

7. A bolt according to claim 3, wherein the second plate is formed with a circular hole for the passage of the barrel and two cuts connected to the circular hole for housing blocks which are rigid with the cylindrical body.

8. In a high safety bolt mounted on a door-leaf having an inner face and an outer face, for the locking and unlocking of said door-leaf and comprising:

a latch bolt movably housed in translation in the casing fixed on the inner face of the door-leaf;

a safety cylinder housed in a hole extending through the door-leaf and comprising a cylindrical body in which is housed, rotatable by a key, a barrel with an outer face having a key opening accessible from the outer face of the door-leaf;

a transmission member for the movement of the barrel to the latch bolt for displacing the latter in a translation movement when the barrel is rotated, the improvement comprising:

a first plate on the side of the outer face of the door-leaf fixed to the latter by fixation means and immobilizing said body in rotation and comprising an outer face;

a second plate soldered to the outer face on the first plate for preventing the access to the immobilization means of the cylindrical body, formed with a hole placed in register with the key hole;

means covering the fixation means; and a cup shaped hood having an opening for the key, housing the second plate and the first plate and crimped onto the latter.

9. In a high safety bolt mounted on a door-leaf having an inner face and an outer face, for the locking and unlocking of said door-leaf and comprising:

a latch bolt movably housed in translation in a casing fixed on the inner face of the door-leaf;

a safety cylinder housed in a hole extending through the door-leaf and comprising a cylindrical body in which is housed, rotatable by a key, a barrel with an outer face having a key opening accessible from the outer face of the door-leaf;

a transmission member for the movement of the barrel to the latch bolt for displacing the latter in a translation movement when the barrel is rotated, the improvement comprising:

a first plate placed on the side of the outer face of the door-leaf and fixed to it by fixation means engaged into passage holes formed in the plate, said means comprising a front end wider than said passage holes;

a second plate formed with holes for housing said ends of the fixation means and fixed on the outer face of the first plate;

a third plate coupled with the second plate and comprising a through-going hole placed in register with the key opening.

10. In combination with a bolt for locking and unlocking with a sliding latch bolt a door-leaf relative to a door frame, a safety cylinder housed in a hole extending through the door-leaf, protruding relative to the outer face of the latter and containing a barrel rotating under the action of the key corresponding to said lock, transmission means between said barrel and the sliding locking and unlocking latch bolt, on the outer face of the door-leaf, a plate device having a first plate fixed on the outer face of the door-leaf and which immobilizes in rotation the cylinder when its protruding portion extends through the door-leaf, the cylinder comprising a cylindrical body and a flange extending transversely relative to said body, a plate of the device being formed with an opening mating with the flange for immobilizing the cylinder in rotation, a further plate applied against the other face of the plate formed with a mating opening and the hole of which has a cross-sectional area smaller than that of the flange.

11. A bolt according to claim 10, comprising a third plate soldered onto the outer face of said further plate and applied against the outer end frontal face of the cylinder.

12. A bolt according to claim 11, wherein the third plate is formed with a hole which is coaxial with the cylinder and whose cross-sectional area is smaller than that of the adjacent frontal face of the cylinder.

13. A bolt according to claim 12, wherein the plates other than the third plate are formed with holes for the passage of the stems of screw bolts, the fixation being carried out by nuts which are part of said screw bolts and are screwed on the ends of said stems which are protruding relative to the inner face of the door-leaf.

14. A bolt according to claim 13, wherein the holes of the second plate are larger than the holes of the third plate for housing the heads of the screw bolts.

15. A bolt according to claim 10, wherein the plate device is enclosed inside a flat cup-shaped hood with its edge which is adjacent the opening crimped onto the periphery of the first plate.

16. In combination with a bolt for locking and unlocking with a sliding latch bolt a door-leaf relative to a door frame, a safety cylinder housed in a hole extending through the door-leaf, protruding relative to the outer face of the latter and containing a barrel rotating under the action of the key corresponding to said lock, transmission means between said barrel and the sliding locking and unlocking latch bolt, on the outer face of the door-leaf a plate device having a first plate fixed on the outer face of the door-leaf and which immobilizes in rotation the cylinder when its protruding portion extends through the door-leaf, the plate device being enclosed inside a flat cup-shaped hood with its edge which is adjacent the opening crimped onto the periphery of the first plate, and a hollowed plate interposed between the first plate and the outer face of the door-leaf.

17. A bolt according to claim 16, wherein the hollowed plate is, in its various dimensions, smaller than the other plates.

18. A plate assembly for use with a high safety bolt having a key opening and coupled with a cylinder which is operated by a key and which bolt and cylinder is mounted on a door-leaf having an inner face and an outer face, the bolt operating to lock and unlock the door-leaf, the plate assembly comprising:

fixation means for coupling the assembly to the door-leaf;

means for receiving part of the cylinder;

a first plate adapted to be placed on the side of the outer face of the door-leaf and being adapted to be fixed to the door leaf by the fixation means engaged into passage holes formed in the first plate, said fixation means comprising a front end wider than said passage hole;

a second plate formed with holes for housing said ends of the fixation means when being coupled with the outer face of the first plate;

a third plate coupled with the second plate and comprising a through going hole adapted to be placed in register with the key opening of the cylinder to facilitate the insertion of the key.

19. The invention in accordance with claim 18, wherein the second plate is fixed on the outer face of the first plate.

20. The invention in accordance with claim 18, wherein the third plate is soldered on the second plate.

21. The invention in accordance with claim 18, wherein the third plate covers the ends of the fixation means.

22. The invention in accordance with claim 18, wherein a hood is provided with a key opening, in the general shape of a cup and houses the plates and being crimped onto the first plate.

23. The invention in accordance with claim 18, wherein the second plate is provided with a hole for housing the front end of the bolt.

24. The invention in accordance with claim 18, wherein a plate member is adapted to extend over the outer face of the bolt providing a through going hole placed in registry with the key opening of the bolt for facilitating the insertion of the key.

25. The invention in accordance with claim 18, wherein means are provided for covering the fixation means.

26. In a high safety bolt for mounting on a door-leaf having an inner face and an outer face, for the locking and unlocking of said door-leaf and comprising:

a latch bolt movably housed in translation in a casing and adapted to be fixed on the inner face of the door-leaf;

a safety cylinder adapted to be housed in a hole extending through the door-leaf and comprising a cylindrical body in which is housed, rotatable by a key, a barrel with an outer face having a key opening accessible from the outer face of the door-leaf;

a transmission member for the movement of the barrel to the latch bolt for displacing the latter in a translation movement when the barrel is rotated, the improvement comprising:

a first plate adapted to be placed on the side of the outer face of the door-leaf and fixed to it by fixation means engaged into passage holes formed in the plate, said means comprising a front end wider than said passage holes;

a second plate formed with holes for housing said ends of the fixation means and fixed on the outer face of the first plate;

a third plate coupled with the second plate and comprising a through-going hole placed in register with the key opening.

27. The invention in accordance with claim 26, wherein means are provided for covering the fixation means.

* * * * *